United States Patent [19]

Fast

[11] Patent Number: 4,564,548

[45] Date of Patent: Jan. 14, 1986

[54] COVER STRIP FOR DISPLAY SHELF

[76] Inventor: Jacob Fast, 6850 NW. 12th Ave., Ft. Lauderdale, Fla. 33309

[21] Appl. No.: 673,739

[22] Filed: Nov. 21, 1984

[51] Int. Cl.[4] ..... E04F 13/00

[52] U.S. Cl. ..... 428/121; 428/133; 428/904.4

[58] Field of Search ..... 428/121, 133, 904.4, 428/535

[56] References Cited

U.S. PATENT DOCUMENTS

| | | | |
|---|---|---|---|
| 1,975,251 | 10/1934 | Caplan | 428/121 X |
| 2,141,606 | 12/1938 | Karfiol | 428/904.4 X |
| 2,143,075 | 1/1939 | Klav | 428/904.4 X |
| 3,650,881 | 3/1972 | Giannone, Sr. | 428/133 |
| 3,741,079 | 6/1973 | Bossons et al. | 428/133 X |
| 3,779,448 | 12/1973 | Wootten | 428/133 X |
| 4,398,495 | 8/1983 | Harris, Jr. et al. | 428/121 X |

*Primary Examiner*—Henry F. Epstein
*Attorney, Agent, or Firm*—Holman & Stern

[57] ABSTRACT

A cover strip for at least the upper corner and front surface member of a display shelf is an integrally formed sheet of plastic having pre-formed fold lines extending widthwise. When deployed, the fold lines overlie respective right-angle corners formed by the forward facing edge of the shelf. In one embodiment the lower edge of the cover strip is folded to extend forwardly and upwardly about a flange member on the shelf to resiliently contact the underside of the shelf. The opposite end of the cover strip may include projections which extend through holes defined in the shelf to secure the cover strip in those holes. In an alternative embodiment, projections extend from opposite edges of the cover strip to engage respective holes in the support member and/or in a flange member disposed beneath the support member of the shelf, with yet another embodiment having locking tabs to overlie the rearmost edge of the flange member. Adhesive means may be substituted for the tabs and one embodiment is designed for use with a shelf having a price channel as its front surface member. The cover strip serves to protect against injury to persons rubbing against the shelf edge while providing a more decorative appearance and permitting display of merchandise-related indicia.

14 Claims, 13 Drawing Figures

COVER STRIP FOR DISPLAY SHELF

BACKGROUND OF THE INVENTION

1. Technical Field

The present invention relates to merchandise display structures and, more particularly, to a cover for the forward surface of a merchandise display shelf.

2. Discussion of the Prior Art

Shelves which are commonly employed for supporting merchandise for display in retail establishments often have forward-facing surfaces or edges which are unattractive and, in some instances, capable of causing injury to store personnel or customers. Specifically, shelves of the type in question commonly include a top support surface or member with an undersurface, both generally horizontally oriented, a short generally vertically-oriented forward-facing front surface member, and a horizontal rearwardly extending flange member disposed beneath the support member to define a channel between the support member, the front surface member and the flange member. Another type of shelf member commonly in use has a price channel with upper and lower lips as the front surface member to receive paper or plastic tags having price or inventory information thereon. Rough corners at the intersections of the front surface member and the support member of the shelf or between the front surface member and the flange member of the shelf can cause cuts to store personnel or customers who run their hands along the corners. Frequently, the front surface member itself is unattractive and, in some cases, not intended for purposes of display.

OBJECT AND SUMMARY OF THE INVENTION

It is therefore an object of the present invention to provide a cover strip which can be easily deployed at least over the upper corner and front surface member of a display shelf of the type described.

It is another object of the present invention to provide a cover strip for a display shelf, which strip eliminates any danger to store personnel and customers, improves the decorative appearance of the shelf, and renders the front surface member of the shelf useful for displaying indicia relevant to the displayed merchandise.

It is still another object of the present invention to provide a cover strip for a merchandise display shelf, which strip can be easily deployed and removed and which, when deployed, improves the appearance of the shelf, eliminates safety hazards associated with the shelf and permits price and other merchandise-related indicia to be displayed therefrom.

In accordance with the present invention a number of embodiments of cover strips are provided, in each instance covering at least the upper corner and major portion of the front surface member of the shelf. One of the embodiments is designed for use with the type of shelf that includes a price channel as its front surface member and is designed to rest within the lip formed by the price channel and be secured to the upper or support surface of the shelf to cover the major portion of the price channel itself and the upper corner which is most dangerous to personnel. This embodiment can be transparent so as to enable information-bearing tags in the price channel to be viewed through the cover strip, while being protected in use.

Other embodiments of the cover strip of this invention are designed to cover both the upper and lower corners of the front surface member, that is, the corners wherein the front surface member joins the shelf support member and the corner wherein the front surface member joins the lower flange member of the shelf, thereby protecting store personnel and customers and, at the same time, providing a more attractive edge to the shelf. This embodiment can also be transparent so that information-bearing tags can be carried between the cover strip and the front surface member of the shelf or, can be opaque to cover an otherwise unattractive shelf member and provide an attractive contrasting color. Additionally, indicia can be provided on such a cover strip, either by being printed directly thereon or by having adhesive tag members secured thereto.

In accordance with all of the embodiments of the present invention a cover strip for the front surface member of a merchandise display shelf includes an integrally-formed elongated strip of plastic material which is longer in width than in height (i.e. length). In one embodiment the plastic material has three parallel fold lines extending widthwise in the long dimension of the strip to subdivide the strip into four sections. A first section, including the uppermost widthwise edge of the strip, is oriented along the top surface of the support shelf and may include a plurality of tabs which extend from the edge of the strip to engage holes defined in the shelf. A second section of the strip is folded to be perpendicular to the first or upper section and extends along the front surface member so that the corner formed between the front surface member and the support surface of the shelf abuts the first fold line. The second fold line resides against a second corner formed at the intersection of the front surface member and a flange member disposed beneath the shelf. A third section of the strip extends rearwardly from the second fold line along the bottom of the flange member. The third fold line is disposed against the rearward edge of the flange member so that the fourth section of the strip is bent to extend forwardly and upwardly toward the underside of the shelf. This edge of the strip resiliently engages the shelf underside to hold the cover strip in place.

In another embodiment of the present invention only two fold lines are provided. The bottom of the strip includes widthwise-spaced projections for engaging holes defined in the flange member to secure the bottom edge to the flange and prevent inadvertent dislodgement of the strip.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings wherein like elements in the various figures are designated by the same reference numerals, and wherein.

DESCRIPTION OF THE PREFERRED EMBODIMENTS

Figure 1:
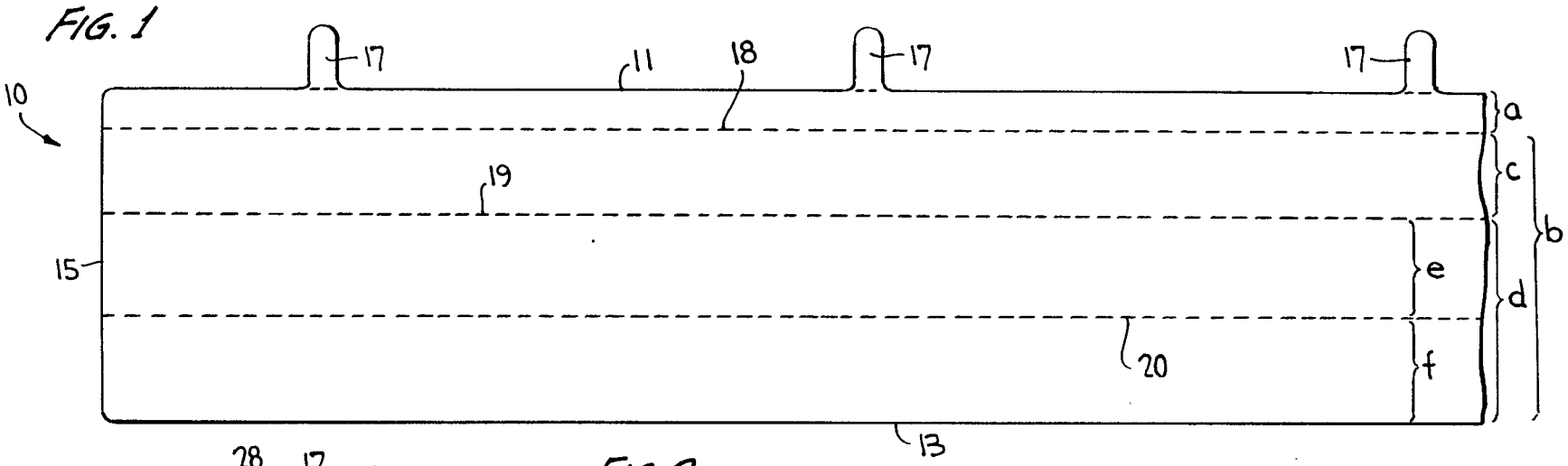
FIG. 1 is a partial view in plan of a cover strip according to one embodiment of the present invention prior to deployment.
Figure 2:
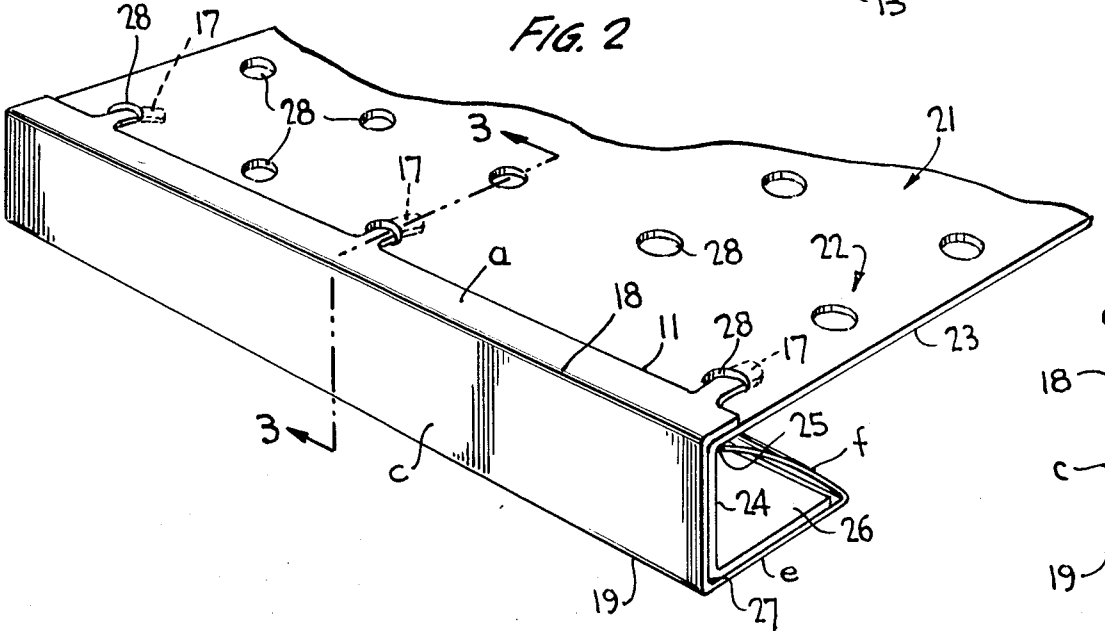
FIG. 2 is a view in perspective of a shelf showing the cover strip of FIG. 1 deployed over the front surface member thereof.
Figure 3:
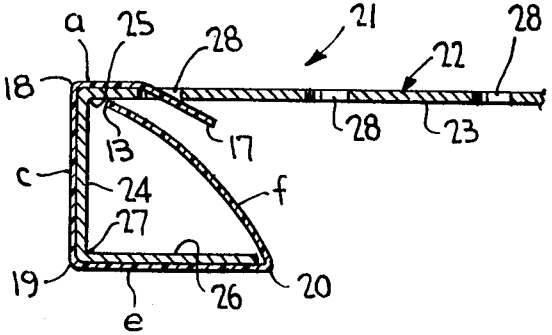
FIG. 3 is a view in section taken along lines 3—3 of FIG. 2.

Referring specifically to FIGS. 1-3 of the accompanying drawings, a cover strip blank for a shelf is generally designated by the reference numeral 10 and takes the form of a generally rectangular integrally-formed sheet of flexible plastic material. Sheet 10 is elongated widthwise and includes two widthwise-extending parallel edges 11 and 13, with edge 11 being the upper edge and edge 13 being the bottom edge in use. Two lengthwise extending edges 15 (only one being shown in FIG. 1) extend perpendicular to edges 11 and 13 and are very much shorter than edges 11 and 13. In a preferred embodiment, edges 11 and 13 are at least five times, and preferably on the order of ten times, longer than edges 15. A plurality of tab-like members 17 extend perpendicularly from upper edge 11 at regularly spaced distance intervals. Tab-like members 17, in the embodiment of FIGS. 1-3, take the form of short stub or stem-like members which are rounded at their distal ends. The spacing between the tab-like members 17 in a widthwise sense corresponds to the spacing between holes defined in a support shelf described hereinbelow.

In this embodiment, three parallel fold lines in the form of permanent creases or perforations 18, 19 and 20 extend throughout the entire width of sheet 10 and subdivide the sheet into four sections between widthwise-extending edges 11 and 13. The section defined between edge 11 and fold line 18 is generally the shortest lengthwise of the four sheet sections and is referred to herein as upper section a, the remainder of the sheet being generally referred to as the lower section b, at least these two sections being common in all embodiments of this invention. In this embodiment, the lower section b is further divided by fold line 19 into first and second sub-sections, c and d, respectively, the second sub-section being even further divided by fold line 20 into a bottom sub-section e and a terminal sub-section f. The first sub-section c is generally the next shortest section lengthwise; the bottom sub-section e and the terminal sub-section f each being longer than the other two sections, depending, of course, on the configuration of the shelf to be covered.

The cover strip illustrated in FIG. 1 is intended for use in conjunction with a shelf structure of the type illustrated in FIGS. 2 and 3. That shelf structure 21 includes a support member 22 having an upper surface for supporting merchandise items for display and an undersurface 23. Support member 22 is generally horizontally oriented in use. A forward-facing edge or front surface member 24 of the shelf structure depends generally vertically downward from support member 22 and intersects this member at a corner 25. Thus, corner 25 extends generally horizontally along the upper edge of front surface member 24. A bottom flange member 26 extends perpendicular to front surface member 24 and rearwardly of that member in spaced parallel relation to support member 22. Flange member 26 intersects the bottom of front surface member 24 at a corner 27 which extends generally horizontally and in parallel spaced relation to corner 25. Shelf 21 commonly has a plurality of spaced holes 28 defined therethrough. At least some of the spaced holes 28 are disposed in a row which extends in parallel spaced relation to corner 25. At least some of the holes in this forwardmost row of holes 28 are spaced at regular intervals corresponding to the spacing between tab-like member 17 which extend generally perpendicularly from upper edge 11 of the sheet 10.

When the sheet or cover strip 10 is deployed, as illustrated in FIGS. 2 and 3, the upper section a defined between fold line 18 and edge 11 is disposed horizontally and adjacent the top surface of support member 22. Tab-like members 17 extend into respective holes 28 to hold the upper section of the sheet in place on shelf 21. In this regard, the width of tab-like members 17 is preferably slightly greater than the diameter of holes 28 (or other suitable dimension of holes 28 if the holes are not circular) so that the tab-like members are frictionally engaged in the holes. Sheet 10 is bent at a right angle about fold line 18 so that the first sub-section c between fold lines 18 and 19 depends vertically from fold line 18 and extends along the front surface member 24 and covers corner 25. In this position the fold line 18 is adjacent the corner 25 between the front surface member 24 and support member 22. The sheet 10 is also bent along fold line 19 so that the bottom sub-section e defined between fold lines 19 and 20 extends horizontally rearwardly along the bottom surface of flange member 26. In this position, the fold line 19 abuts the corner 27 of the shelf structure. The final fold line 20 is bent about the rearward edge of flange member 26 so that the terminal sub-section f of cover sheet 10 extends upwardly and forwardly, generally toward corner 25. This terminal sub-section f is sufficiently long so as to be bent and thereby cause lower edge 13 of the cover sheet to resiliently abut the inside surface of the corner 25. This resilient abutment serves to secure the lower edge of the cover sheet against the shelf and cooperates with the frictional engagement of tab-like members 17 in holes 28 to positively secure the cover sheet in place and prevent inadvertent removal. For this reason it is important that the lengthwise dimension of the terminal sub-section f between edge 13 and fold line 20 be relatively long; that is, if the terminal sub-section f of the sheet is too short, the resilient engagement of edge 13 against the inside surface of corner 25 will not be possible and positive engagement of the cover sheet to the shelf underside will not be present.

Figure 4:
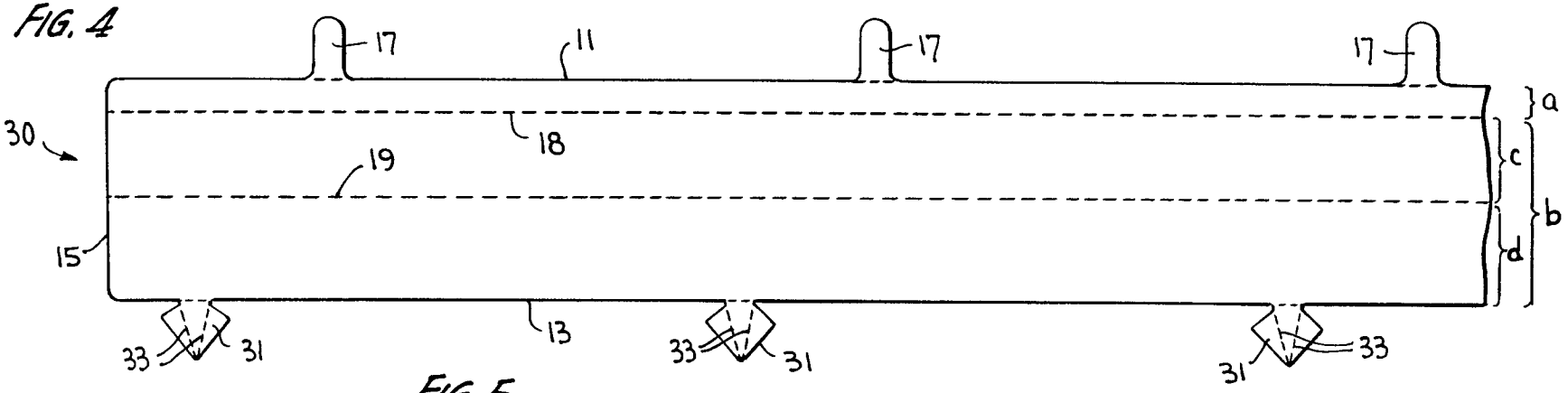
FIG. 4 is a partial view in plan of another embodiment of the cover strip of the present invention.
Figure 5:
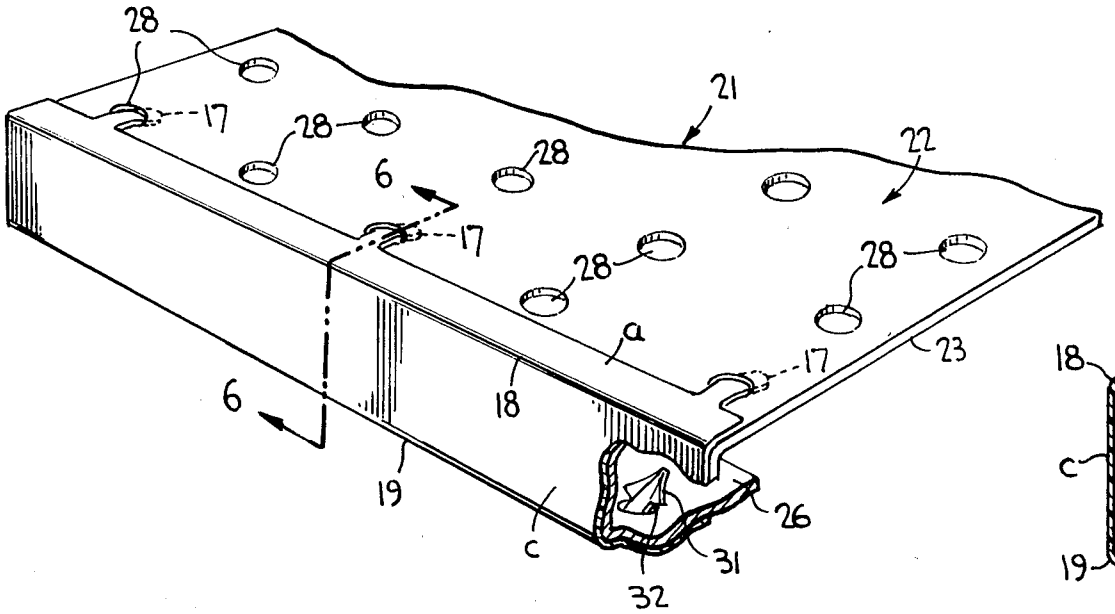
FIG. 5 is a view in perspective of the cover strip of FIG. 4 shown deployed over the front surface member of a shelf.
Figure 6:
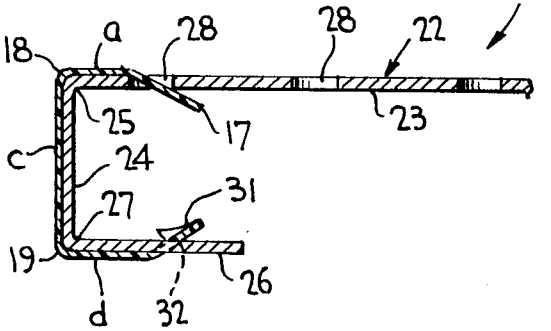
FIG. 6 is a view in section taken along lines 6—6 of FIG. 5.

Another embodiment of the cover sheet is illustrated in FIGS. 4-6 to which specific reference is now made.

In the embodiment illustrated in FIG. 4, sheet 30 is substantially similar to sheet 10 with some important exceptions. One exception includes the fact that only two fold lines, namely fold lines 18 and 19, are present in cover strip 30, that is, the second sub-section d is not further divided. A plurality of tab-like members or projections 31 extend from lower edge 13 at regularly spaced distance intervals which, in the embodiment of FIG. 4, are equal to the distance intervals between tab-like members or projections 17 provided on the upper edge 11. However, projections 31 are preferably off-set, in a widthwise sense, from tab-like members 17. Projections 31 are configured generally as arrowheads and have respective fold lines 33 which render the wings of the arrowheads deformable from the plane of the strip or sheet 30. The transverse distance between the outermost extremities of the wings of the arrowheads is greater than the diameter or other widthwise dimension of holes 28 defined in support member 22 or other holes 32 defined in flange 26. However, by folding or bending the arrowheads along fold lines 33, the arrowheads can be inserted into these holes and then released to engage the support member or flange member on the opposite side of the location of insertion.

Deployment of the strip 30 is illustrated in FIGS. 5 and 6. It should be noted that the cover strip may be designed to be oriented in either of two directions. Specifically, the cover strip may be oriented so that tab-like members such as shown at 17 are inserted into the support member 22 through holes 28, whereas tab-like members or projections such as shown at 31 would be inserted into the holes 32 in flange member 26. On the other hand, tab-like members or projections such as shown at 31 may be inserted into holes 28 of support member 22, and tab-like members such as shown at 17 may be inserted into holes 32 in flange member 26. Of course, the location of the fold lines 18 and 19 must be provided appropriate to the mode of use. However, it is important to be noted that the anchor-like projections such as shown at 31 can be located to be inserted in holes in the support member 22 or the flange member 26. In fact, anchor-like projections such as shown at 31 may be provided along both edges 11 and 13. It follows, of course, that tab-like members such as shown at 17 may also be provided along both edges 11 and 13.

In any case, for deployment in the manner illustrated in FIGS. 5 and 6, fold line 18 is deployed along the corner 25, whereas fold line 19 is deployed along corner 27. Projections 31 are folded along fold lines 33 and inserted into holes 32 so that the projections 31 may be anchored on the upper side of the flange member 26. Tabs 17 are inserted through holes 28 so as to frictionally engage these holes and hold the upper section a defined between fold line 18 and edge 11 against the upper surface of the support member 22.

Figure 7:
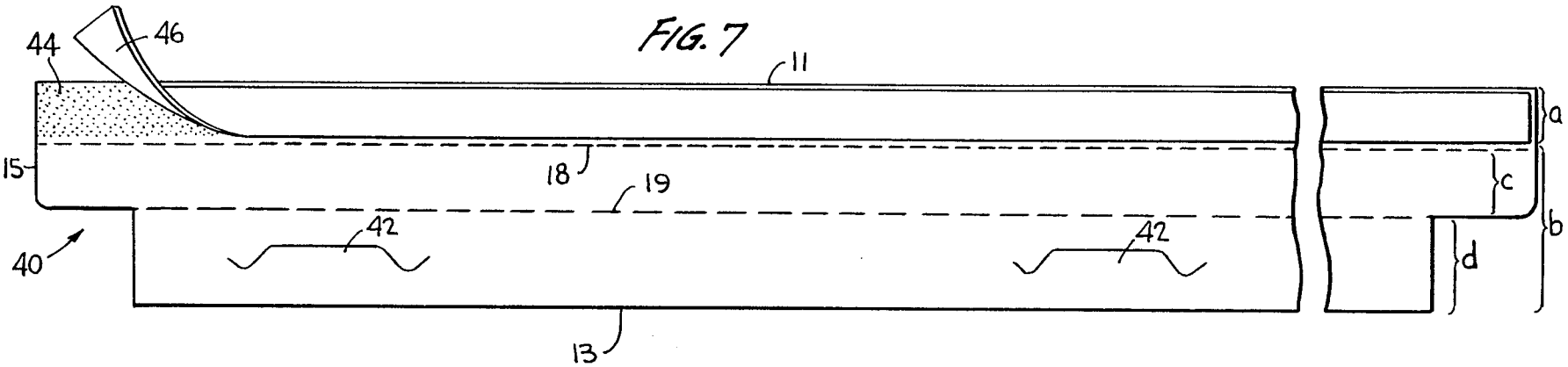
FIG. 7 is a plan view, partially broken away for illustrative convenience, of yet another embodiment of the present invention, prior to deployment.
Figure 8:
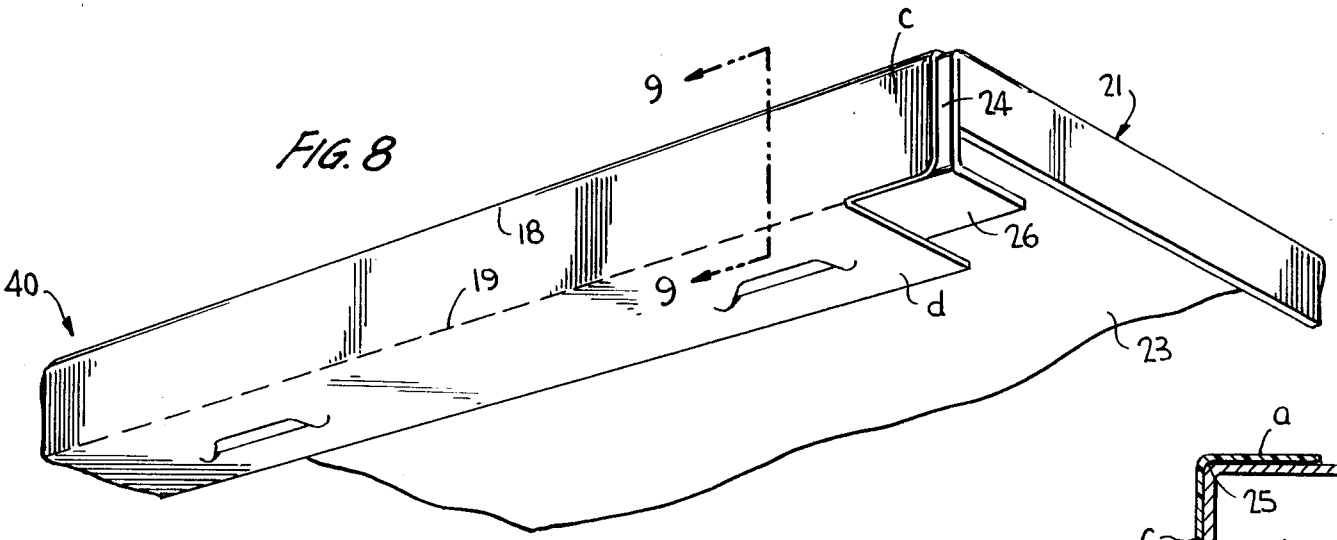
FIG. 8 is a view in perspective of a shelf showing the cover strip of FIG. 7 deployed over the front surface member thereof.
Figure 9:
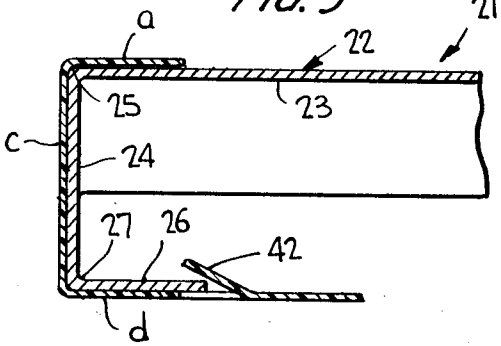
FIG. 9 is a view in section taken along lines 9—9 of FIG. 8.
Figure 10:
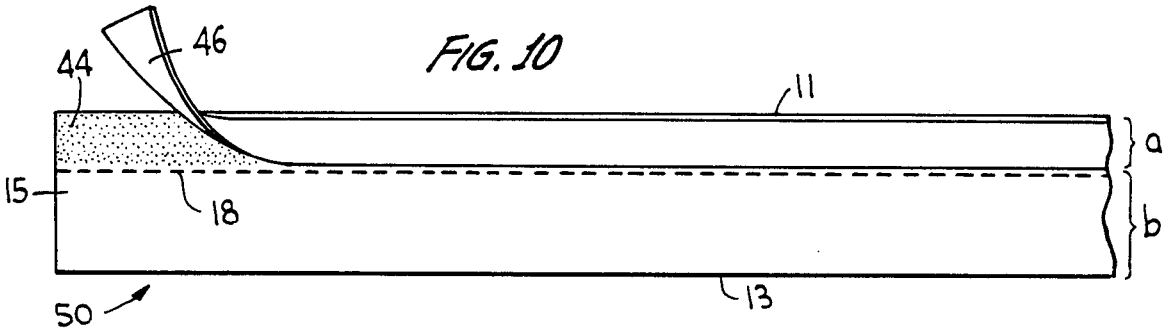
FIG. 10 is a partial plan view of yet a further embodiment of a cover strip according to the present invention, prior to deployment.
Figure 11:
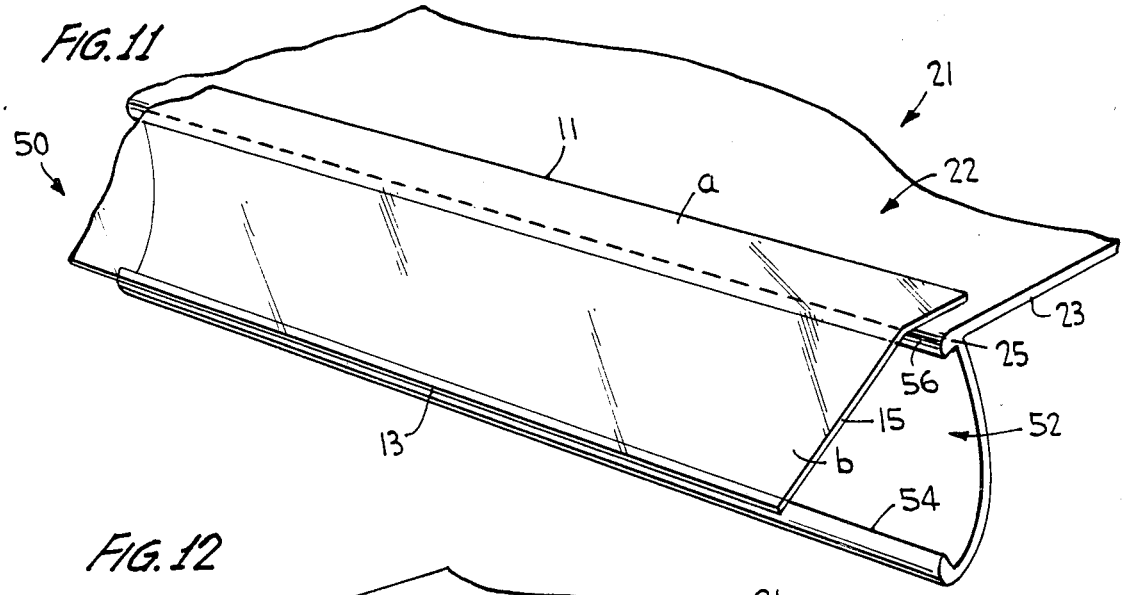
FIG. 11 is a view in perspective of a shelf showing the cover strip of FIG. 10 partially in place.
Figure 12:
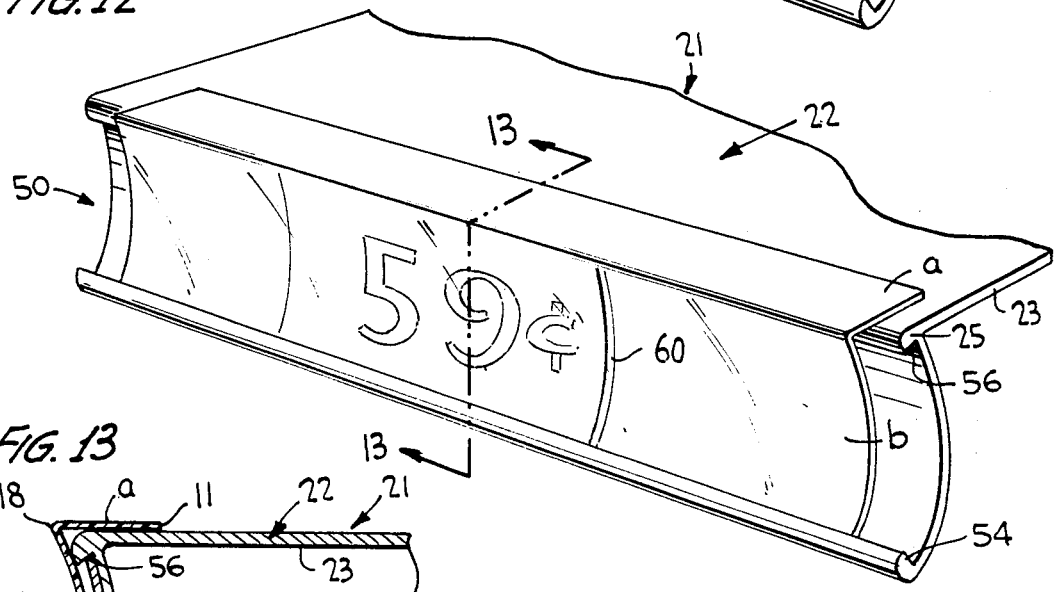
FIG. 12 is a view in perspective similar to FIG. 11, showing the cover strip fully deployed.
Figure 13:
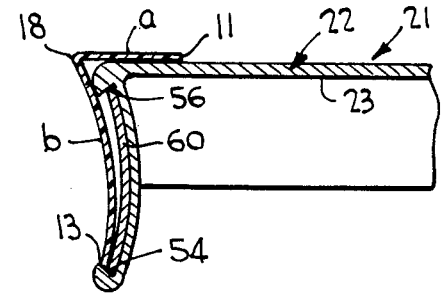
FIG. 13 is a view in section taken along lines 13—13 of FIG. 12.

Referring now to the embodiment of FIGS. 7–9 a further modification 40 of cover strip is shown for use in connection with a shelf that does not have apertures on either its support member 22 or its flange member 26. In this embodiment, two fold lines, 18 and 19, similar in nature to the fold lines in the embodiment of FIGS. 4–6 are provided, with the second sub-section d being longer than the flange member 26 of the shelf 21 and having tab-like members or locking tabs 42 defined in the second sub-section d spaced inwardly from the lower edge 13 and adapted to overlie the flange member 26 of the shelf 21 in the manner shown particularly in FIGS. 8 and 9.

Additionally, in this embodiment, the means for supporting the upper section a of the cover strip 10 on the upper surface of the support member 22 comprises adhesive means designated generally by the reference numeral 44 with a release strip 46 provided thereover, prior to use, in a conventional manner.

Thus, in use, the embodiment of FIGS. 7–9 is folded first along the fold lines 18, 19 with the adhesive means 44 inside, when folded. Then the release strip 46 is removed and the cover strip is aligned with the shelf. The adhesive means is then pressed on the upper surface of the support member 22 in an obvious manner. Conventional adhesive means are well known and need not be described in detail herein, but it is evident that, if alignment is not proper, the element can be removed from the shelf and re-aligned. Finally, the locking tabs 42 are pushed inwardly and over the flange member 26 of the shelf to secure the cover strip 40 in position.

Finally, reference is made to the embodiment 50 of FIGS. 10–13 which is particularly adapted for use with a shelf 21 having as its front surface member a price channel 52 with an upwardly opening lower lip 54 and a downwardly opening upper lip 56 conventionally used to receive information bearing tags such as shown at 60. In this embodiment, an adhesive means such as 44, 46 similar to that shown in FIGS. 7–9 is provided to secure the upper section a to the upper surface of the support member 22 and the lower edge 13 of the cover strip 10 is flexed and engaged in the lower lip 42 of the price channel 40 in an obvious manner.

From the foregoing, it will be clear that various combinations of the embodiments shown herein may be made. Thus, if a shelf has apertures, tab-like projections can be used in place of the adhesive means in the embodiments of FIGS. 7–9 and 10–13. Alternatively, the adhesive means may be substituted for the tab-like projections in the embodiments of FIGS. 1–3 and 4–6, notwithstanding the presence of the apertures in the shelf member. In fact, both tab-like members and adhesive means may be provided, if desired.

It will be apparent that the cover strip serves a protective function against cuts or metal splinters which might be caused to a shopper or store personnel rubbing against a rough metal edge of the shelf 21. In addition, the cover strip 10, 30, 40 or 50 may be fabricated from a colorful plastic material so as to render the front surface member of the shelf pleasingly decorative in appearance. The forward-facing edge of the cover strip, in use, is suitable to receive adhesive-backed labels, or the like, which display indicia relating to the displayed merchandise, which indicia may include price, descriptive information, bar codes, etc. It is also possible to fabricate the cover strip 10, 30, 40 or 50 from transparent plastic material in which case indicia-bearing tags may be inserted between the front surface member of the shelf and the cover strip so as to provide a display of the desired and/or necessary information.

While I have described and illustrated various specific embodiments of my invention, it will be clear that variations from the details of construction which are specifically illustrated and described may be resorted to without departing from the true spirit and scope of the invention as defined in the appended claims.

What is claimed is:

1. A cover strip for a front surface of a shelf wherein the shelf has a generally horizontally extending support member with an upper support surface for supporting merchandise items for display and an undersurface, a front surface member, generally vertically-oriented and having a predetermined vertical height with an upper corner at its junction with the support member and a spaced lower corner, the front surface member having a horizontal width which is very much greater than its height, said cover strip comprising:

an integral sheet of flexible plastic material having a generally rectangular configuration with a width very much greater than its height and having at least a first fold line defined therein extending widthwise across the entire width of said sheet and dividing said sheet into an upper section and a lower section, said strip further comprising a first widthwise extending edge at the upper terminus of said upper section and a second widthwise extending edge at the lower terminus of said lower section, said upper section, when said sheet is folded along said first fold line, resting on the support surface of the shelf, means for securing said upper section to the support surface of the shelf, and means for securing said lower section to the shelf to cover at least the upper corner and a major portion of the front surface member of the shelf with said cover strip.

2. The cover strip according to claim 1 wherein said means for securing said upper section to the support surface of the shelf comprises adhesive means on the undersurface of said upper section.

3. The cover strip according to claim 1 wherein the support member of the shelf includes a plurality of holes defined therethrough and spaced regularly widthwise, and wherein said means for securing said upper section to the support surface of the shelf comprises a plurality of spaced tab-like members extending generally perpendicularly from said first edge, said tab-like members being sized and spaced to be inserted into respective holes in the support member of the shelf.

4. The cover strip according to claim 3 wherein said tab-like members each includes a stem portion and a distal end in the general shape of an arrowhead which is wider than the holes in the support member of the shelf, said arrowhead being transversely resiliently flexible to permit insertion of said arrowhead into a respective hole.

5. The cover strip according to claim 1 wherein the front surface member of the shelf comprises a price channel having an upwardly opening lower lip at the lower corner thereof, and wherein said means for securing said lower section to the shelf comprises said second edge of said strip resting within the lip, said lower section of said strip being slightly longer than the predetermined vertical height of the front surface member of the shelf so as to be flexed within the price channel thereof.

6. The cover strip according to claim 1 wherein said means for securing said lower section to the shelf comprises means for engaging the undersurface of the shelf.

7. The cover strip according to claim 6 wherein the shelf includes a flange member disposed generally horizontally and intersecting the front surface member thereof along the spaced lower corner and extending rearwardly a predetermined distance therefrom to define a channel between the support member, the front surface member and the flange member, and wherein said strip includes a second fold line defined therein extending widthwise across the entire width of said sheet generally parallel to said first fold line, said first and second fold lines being spaced from one another by a distance which is substantially equal to the predetermined vertical height of the front surface member of the shelf, said second fold line dividing said lower section of the strip into a first and second sub-section, the first sub-section being intermediate the upper section and the second sub-section and covering the front surface member of the shelf in use, said means for securing said lower section to the shelf being provided on said second sub-section.

8. The cover strip according to claim 7 wherein the flange member of the shelf includes a plurality of holes defined therethrough and spaced regularly widthwise, said means for securing said lower section to the shelf comprising a plurality of spaced tab-like members extending generally perpendicularly from said second edge, said tab-like members being sized and spaced to be inserted into respective holes in the flange member of the shelf.

9. The cover strip according to claim 8 wherein said tab-like members each includes a stem portion and a distal end in the general shape of an arrowhead which is wider than the holes in the flange member of the shelf, said arrowhead being transversely resiliently flexible to permit insertion of said arrowhead into a respective hole.

10. The cover strip according to claim 7 wherein said second sub-section of said strip is longer than the flange member of the shelf, and wherein said means for securing said lower section of said strip to the shelf comprises a plurality of spaced locking tabs defined in said second sub-section spaced inwardly from said lower edge and adapted to overlie the flange member of the shelf in use.

11. The cover strip according to claim 7 further comprising a third fold line defined in said second sub-section generally parallel to said second fold line and extending widthwise across the entire width of said sheet, said third fold line being spaced from said second fold line a distance substantially equal to the length of the flange member of the shelf to divide said second sub-section into a bottom sub-section underlying the flange member in use and a terminal sub-section, said terminal sub-section extending generally upwardly and forwardly and being resiliently bent with said second edge forced against the undersurface of the support member where it joins the front surface member of the shelf.

12. The cover strip according to claim 11 wherein said terminal sub-section has a height which is greater than said first sub-section.

13. The cover strip according to claim 1 wherein said sheet is transparent.

14. The cover strip according to claim 1 wherein said sheet is opaque.

* * * * *